United States Patent [19]

Scarpellino, Jr. et al.

[11] 4,157,943

[45] Jun. 12, 1979

[54] COMPOSITE ELECTRODE FOR ELECTROLYTIC PROCESSES

[75] Inventors: Anthony J. Scarpellino, Jr., Tuxedo; James McEwen, Warwick, both of N.Y.; William G. Borner, Ringwood, N.J.

[73] Assignee: The International Nickel Company, Inc., New York, N.Y.

[21] Appl. No.: 924,631

[22] Filed: Jul. 14, 1978

[51] Int. Cl.[2] ..... C25B 11/08; C25B 11/10; C25D 3/50; C25D 5/50

[52] U.S. Cl. ..... 204/37 R; 204/32 R; 204/38 S; 204/38 B; 204/40; 204/43 N; 204/45 R; 204/46 R; 204/47; 204/112; 204/113; 204/291; 204/292; 204/293; 204/105 R; 204/290 R; 204/290 F; 427/229

[58] Field of Search ..... 204/43 N, 290 R, 290 F, 204/293, 291–292, 37 R, 45 R, 112–113, 46–47, 38 S, 38 B, 40, 32 R; 427/229

[56] References Cited

U.S. PATENT DOCUMENTS

| | | | |
|---|---|---|---|
| 3,616,445 | 10/1971 | Bianchi et al. | 204/290 F |
| 3,846,273 | 11/1974 | Bianchi et al. | 204/290 F |

FOREIGN PATENT DOCUMENTS

| | | | |
|---|---|---|---|
| 461159 | 2/1973 | U.S.S.R. | 204/43 N |

*Primary Examiner*—R. L. Andrews
*Attorney, Agent, or Firm*—Miriam W. Leff; Ewan C. MacQueen

[57] ABSTRACT

A composite electrode especially suitable for electrowinning processes comprising an electrically conductive substrate having on at least a part of its surface a multilayer coating, said coating comprising:

(a) a barrier layer directly on the substrate;

(b) a ruthenium dioxide-containing non-electrodeposited surface layer; and (c) between the barrier layer and the surface layer, an intermediate layer consisting of an electroplated ruthenium-iridium deposit, said ruthenium-iridium deposit being at least partially in an oxidized state.

32 Claims, No Drawings

COMPOSITE ELECTRODE FOR ELECTROLYTIC PROCESSES

This invention relates to electrodes for use in electrochemical processes, especially processes for electrowinning of metals. More particularly, the present invention relates to a composite electrode which is especially useful for the electrowinning of nickel.

With the increased emphasis that is presently being placed on carrying out industrial processes with minimized environmental pollution, there has been greater interest in using electrochemical techniques for extracting metals from ores. One method currently being investigated is the electrowinning of metals, which involves the electrodeposition of a metal at the cathode when an external current is impressed on an electrolytic cell. An insoluble anode may be used, and the metal is recovered from an electrolyte which contains the metal as an ion in an appropriate solvent. Electrowinning can be used for recovering a metal from solutions derived, for example, from ores, refining processes, or even from metal scrap. Very high purity metals can be recovered using this technique, given appropriate electrodes, electrolytes and process conditions.

One of the major problems in the electrowinning of metals concerns the development of satisfactory anodes. They must be good conductors and resistant to chemical attack in the environment in which they are used. They must be sufficiently strong to withstand normal handling in commercial use, and they must be effective for the desired reactions at the anode without interfering with the activity at the cathode. For example, when used as an insoluble anode in an electrowinning process, the anode should not affect adversely the purity of the metal deposit at the cathode and should not interfere with the deposit of the metal at an economic current density. In fact, economics plays a major role in the choice of an electrode. Thus, factors which must be considered are the cost of the electrode, its durability and the power requirements associated with its use. As a practical commercial reality cost of the anode not only includes cost of materials and cost of manufacture but royalties or other expenses associated with the use or purchase of proprietary materials.

The electrodes of the present invention are particularly suited for use as insoluble anodes in the electrowinning of nickel. Accordingly the present electrodes are described below mainly in connection with such a process. However, it will be apparent to those skilled in the art that the present electrodes may also be employed for the electrowinning of other metals, e.g., copper, zinc, manganese, cobalt, cadmium, gallium, indium, and alloys thereof, e.g., nickel-cobalt alloys, and for other electrolysis processes, e.g., for the electrolytic production of chlorine from brines, the dissociation of water, cathodic protection (e.g., in seawater or underground) and for battery electrodes.

In a nickel electrowinning process using insoluble anodes described by J. R. Boldt in "The Winning of Nickel", pp. 362–374 (1967), the electrolyte used is a purified leach liquor, which is essentially an aqueous solution of nickel sulfate, sodium sulfate and boric acid and the anodes are made of rolled sheets of pure lead. The principal cathodic reaction is:

$$2(Ni^{++}+2e \rightarrow Ni^{\circ})$$

The principal anodic reaction is:

$$2H_2O \rightarrow O_2+4H^{+}+4e$$

It will be noted that oxygen is released at the anode.

Lead and lead alloys have also been used as anode materials for electrowinning of metals other than nickel, e.g., copper and zinc. The lead alloys are often mechanically stronger and more resistant to certain corrosive environments used in electrowinning processes than pure lead; their operating potential is substantially higher than that of precious metal coated titanium anodes, and there is the ever present possibility of cathode lead contamination, because at open circuit lead dissolves and is then available in solution for deposition at the cathode. Thus, lead has not been an entirely satisfactory anode material.

In fact, very few materials may be used effectively as anodes, especially in oxygen producing environments, because of the severe conditions. Graphite has been used—and its limitations are well known. In recent years there has been considerable interest in replacing graphite electrodes used in the electrolytic production of chlorine from brines with platinum group metal-coated anodes. In general anodes of this type are composed of a valve metal substrate having a coating containing at least one platinum group metal or platinum group metal oxide. The platinum group metal oxides have aroused attention because they are less corrosive than the elemental metals in the chloride and because there is reduced tendency to shorting in cells like the mercury cells. In particular favor recently are anode coatings composed of a platinum group metal oxide and a base metal oxide. Such coatings have been characterized by terms such as mixed crystals, solid solutions, ceramic semi-conductors and so on. It is reported that anodes of this type are now in use for the commercial production of chlorine. Offsetting their high cost are their low power requirements and durability. Examples of the many issued patents in the field are: U.S. Pat. Nos. 3,491,014, 3,616,445, 3,711,385, 3,732,157, 3,751,296, 3,770,613, 3,775,284, 3,778,307, 3,810,770, 3,840,443, 3,846,273, 3,853,739, 4,003,817, 4,070,504. A review of the patents will show that several of the coatings described may contain $RuO_2$ or $RuO_2$ and $IrO_2$ and/or Ir, as well as a valve metal oxide such as $TiO_2$.

The platinum group metals do not all exhibit the same properties when used in electrolytic cells. Their behavior will vary with electrolytic conditions and the reactions which occur. It has been found, for example, that anodes having an outer coating containing oxides of a platinum group metal and a valve metal, e.g. $RuO_2$ and $TiO_2$, which are presently in favor for the production of chlorine, have short life in electrowinning applications where oxygen is produced at the anode. One major problem is that the electrode is passivated, and according to one theory the passivation is caused by penetration of oxygen through the outer coating into the conductive substrate, e.g., a valve metal. Electrodes with intermediate coatings between the active surface coating and the substrate conductors have been proposed. Examples of such electrodes can be found in U.S. Pat. Nos. 3,616,302, 3,775,284 and 4,028,215. None of the proposed electrodes are entirely satisfactory.

A review of the patents listed previously will show that many techniques have been listed for preparing platinum group metal-containing coatings. Despite the convenience of applying coatings by electroplating, the emphasis appears to be on the "paint" application of a platinum group metal compound which will react with oxygen when heated in air to form an oxide, e.g., $RuCl_3$ is converted to $RuO_2$ when heated in air at a temperature of about 200° C. to about 700° C. This impression is borne out by L. D. Burke et al in an article entitled "The Oxygen Electrode" in J. C. S. Faraday I Vol. 73 (11) 1669–1849 (1977), which indicates that $RuO_2$-coated electrodes are usually prepared by heating $RuCl_3$-painted titanium in air for several hours. The article also records the investigation of the possibility of preparing $RuO_2$ electrodes by thermal oxidation of electrodeposited ruthenium, and the finding that the electrodeposited electrode coatings were unsatisfactory from the point of oxygen potential and corrosion, the corrosion being evidenced by the appearance of a yellow color in the solution. Elsewhere it has been reported that from the Pourbaix diagram a likely product of the dissolution of ruthenium in acidic solution is the yellow volatile tetroxide, viz. $RuO_4$.

It has now been found that electrodes prepared with an electrodeposited ruthenium-iridium intermediate coating, which has been at least partially oxidized and which has a non-electrolytically-deposited ruthenium dioxide layer at the surface are very effective oxygen electrodes having low oxygen potentials and being durable in acid environments.

It is an object of the present invention to provide an electrode material which can be used as an insoluble anode in electrolytic processes, particularly for the electrowinning of metals such as nickel, copper and zinc. It is another object to provide an electrode material which has long life and low power requirements when used as an anode in an electrolytic cell. Another object is to provide an electrode material which has corrosion resistance when used as an anode in an aqueous acid environment at the current densities and temperatures of use. Still another object is to provide an electrode which is useful as an insoluble anode for the electrowinning of nickel.

These and other objects of the present invention will become apparent to those skilled in the art from the description and examples set forth below.

According to the present invention a composite electrode material has been found which is especially useful as an insoluble anode for electrowinning of metals, particularly nickel, where oxygen is evolved at the anode and high acid concentrations and elevated temperatures are used.

SUMMARY OF THE INVENTION

In general the electrode of the present invention is a composite electrode for use in an electrolytic cell, and especially useful as an insoluble anode in a process for electrowinning a metal, which comprises an electroconductive substrate having on at least a portion of the surface thereof a multilayer coating, said coating consisting essentially of:

(a) a barrier layer directly on the substrate;
(b) a non-electroplated outer surface layer comprising ruthenium dioxide; and
(c) an intermediate layer between the barrier layer and outer surface layer comprising an electroplated metallic deposit of ruthenium and iridiun, said intermediate layer being at least partially oxidized.

The iridium serves to suppress ruthenium dissolution when the composite electrode is used as an anode under oxygen producing conditions. Accordingly, preferably, the iridium is present in at least a small but effective amount to reduce ruthenium dissolution in the electrolyte during use.

According to one aspect of the present invention the electrode is used as an insoluble anode in an electrolytic cell for electrowinning a metal from a solution containing such metal. In a preferred embodiment the present electrode is used as an anode in a process for electrowinning nickel.

According to still another aspect of the invention a composite electrode is prepared by a method comprising depositing separately three layers sequentially on a valve metal substrate, the first layer being a barrier layer of at least a small but effective amount to preserve the current carrying capacity of the electrodes, and typically a flash coating, up to about 0.5 μm thickness of platinum group metal, the second layer being an intermediate electrodeposited ruthenium-iridium layer of at least about 0.1, and typically up to about 4 or 5 μm, thickness, and the third being a ruthenium-oxide containing outer surface layer, said outer surface layer containing ruthenium dioxide in at least a small but effective amount for a low oxygen potential, wherein before depositing the outer coating, the substrate having the barrier layer and the intermediate layer consisting of a ruthenium-iridium deposit is subjected to an elevated temperature in an oxidizing atmosphere to at least partially oxidize the surface of the ruthenium-iridium deposit.

The ruthenium-iridium electrodeposit may also be referred to as an alloy. By alloy is meant at least a mixture of very fine particles of ruthenium and iridium which has a metallic appearance. The particles may be mixed crystals or in solid solution, the microscopic character of the deposited films being difficult to determine because the films are very thin.

DESCRIPTION OF PREFERRED EMBODIMENTS

A principal feature of the electrode of present invention resides in the particular combination of composition and methods of depositing of the layers in the multilayer coating. The coating as indicated previously is on an electroconductive substrate.

The substrate, which must be electroconductive, should be of a material which will be resistant to the environment in which it is used. The substrate may be, for example, a valve metal or graphite. The term "valve metals" is used in the usual sense as applied to electrode materials. They are high melting, corrosion resistant, electrically conductive metals which passivate, i.e., form protective films in certain electrolytes. Examples of valve metals are titanium, tantalum, niobium, zirconium, hafnium, molybdenum, tungsten, aluminum, and alloys thereof. Titanium is a preferred substrate material because of its electrical and chemical properties, its availability, and, its cost relative to other materials with comparable properties. The configuration of the substrate is not material to this invention. It is well known to use electrodes in many shapes and sizes, e.g., as sheet, mesh, expanded metal, tubes, rods, etc. The titanium may be, for example, a sheath on a more conductive metal such as copper, iron, steel, or aluminum, or combinations thereof.

The valve metal substrate is treated to clean, and preferably to roughen the surface before any coating is applied. Cleaning includes, for example, removal of grease and dirt and also removal of any oxide skin that may have formed on the valve metal. The usual techniques may be used to roughen the surface of the valve metal, e.g., by etching or grit blasting. A particularly suitable technique is to grit blast using silica sand.

The barrier layer deposited on the substrate improves the durability of the electrode. It is believed to serve as an oxygen diffusion barrier for the substrate and/or to behave as a current carrying layer and/or to serve as a proper support layer. By proper support layer is meant that it improves the quality and adherence of the electrodeposited layer. In any event a principal function of the barrier layer is to preserve the current carrying capacity of the electrode in the presence of released oxygen. The barrier layer composition is, advantageously, selected from the group consisting of platinum group metals, gold, alloys, mixtures, intermetallics, oxides thereof. It may also be a silicide, nitride, and carbide of one of the components of the substrate material. Preferably the barrier layer contains at least one of the platinum group metals palladium, platinum, iridium and rhodium. Palladium and iridium are preferred because they are effective in preserving the current carrying capacity of the electrodes, possibly as barriers to $O_2$ transport, without any special treatment. Platinum is effective but requires an additional oxidizing treatment, e.g. by soaking in an oxidizing medium such as in concentrated $HNO_3$ or 0.1N $KMnO_4$. The use of rhodium is not recommended because of its high cost.

It has also been found that silicides, nitrides and carbides of at least one component of the valve metal substrate are suitable as barrier layers. Standard techniques may be used to deposit such coatings on the substrate. These coatings are orders of magnitude greater in thickness than the platinum group metal barrier layers. For example, a nitride coating may be about 2$\mu$ thick and a silicide layer may be about 250$\mu$ thick.

In a preferred embodiment the electrode contains a palladium- or iridium-containing layer adjacent to the valve metal. The palladium layer, which serves as a barrier layer on the substrate, also promotes adherence of the ruthenium-iridium electrodeposited layer to the substrate. The palladium or iridium can be deposited in any manner, e.g., by chemical or thermal decomposition from a solution or slurry deposited on the substrate, or by electroplating, electrophoresis, etc. Electroplating is preferred because it is convenient, inexpensive, rapid, neither labor nor time intensive compared to thermal decomposition, and it is easily controlled compared to, e.g., electrophoresis or chemical or vapor deposition. The palladium layer is at least about 0.05 $\mu$m in thickness. The optimum thickness is about 0.2 $\mu$m. Generally, what is sought is sufficient metal to coat the substrate substantially completely. It has been found, for example that a palladium deposit of 0.25 mg/cm$^2$ is a sufficient deposit to coat completely a sandblasted or otherwise roughened surface of the substrate. Iridium is more difficult to plate than palladium and it is more expensive. However, a flash coating of iridium serves as an effective barrier.

Examples of known palladium electroplating baths are:

| BATH I | | BATH II | |
|---|---|---|---|
| Pd as: | | Pd as: | |
| $PdCl_2 \cdot H_2O$ | 5 to 50 g/l | $Pd(NH_3)_2Cl_2$ | 8–16 g/l |
| $NH_4Cl$ | 20–50 g/l | $NH_4Cl$ | 60–200 g/l |
| HCl | to maintain pH | pH | 8–9.5 |
| pH | 0.1–0.5 | Temp. | 25°–35° C. |
| Temp. | 35°–50° C. | Current | |

-continued

| BATH I | | BATH II | |
|---|---|---|---|
| Current Density | 5–10 mA/cm$^2$ | Density | 10 mA/cm$^2$ |

For an iridium barrier layer, the bath described in U.S. Pat. No. 3,693,219 may be used.

The intermediate layer between the flash coating of palladium and the outer ruthenium-dioxide coating consists essentially of ruthenium and iridium which has been deposited by an electroplating technique.

While ruthenium-iridium co-deposits can be formed by a number of techniques, it is particularly advantageous for the coating to be electroplated in that a metallic coating of suitable thickness can be deposited in one operation, a layer of uniform composition can be formed, and the deposit can be formed rapidly, in a manner which is neither time nor labor intensive compared to chemical or thermal decomposition techniques.

In accordance with the present invention, the ruthenium-iridium layer is deposited in the metallic state by an electroplating technique. Preferably the layer is co-deposited although it is possible to deposit layers separately, e.g., using a ruthenium plating bath described in U.S. Pat. No. 3,576,724 and an iridium plating bath described in U.S. Pat. No. 3,693,219, and diffuse them thermally. While this invention is not confined to any particular electroplating method for producing the layer, an especially suitable method and bath for forming the layer can be found in U.S. application Ser. No. 924,632, filed July 14, 1978, co-pending herewith, and incorporated herein by reference.

As noted above, electroplated ruthenium per se will corrode rapidly at the anode at potentials for oxygen evolution, passing into the acid solution in the octavalent state at potentials greater than about 1.1 V (vs. SCE). This is both costly—in the loss of expensive precious metals—and a hazard in that there is a potential for vaporization of $RuO_4$. It has been found that iridium addition in the electrodeposited coating suppresses the dissolution of ruthenium. The level of iridium addition which is effective depends on the conditions under which the anode is used. Very small additions of iridium have a marked effect in suppressing the ruthenium dissolution. For example, in an accelerated life test in sulfuric acid at a current density of 500 mA/cm$^2$ and ambient temperature, roughly 1 weight % iridium addition increased the anode life from 1 hour (without iridium addition) to at least 11 hours, and even as high as 95 hours, and similarly 2 weight % iridium further increased the anode life. The iridium addition is typically in the range of about 1% up to about 36%.

For electrowinning of nickel, e.g. at current densities of the order of 30 to 50 mA/cm$^2$ and temperatures of about 55° to 80° C., very small additions of iridium are effective. In an advantageous embodiment of the invention for use at current densities up to about 50 mA/cm$^2$, the level of iridium in the electrodeposited layer is at least about and preferably greater than about 1%, e.g. about 2% or 4%. For example, in such anodes having a further outer layer of non-electroplated $RuO_2$, there is no observable dissolution of ruthenium with an iridium level of about 4 weight %. When used for current densities greater than about 50 mA/cm$^2$, the iridium level is preferably at least about 2%. Without the $RuO_2$ outer layer a greater amount of iridium is required than 4%, e.g., 7%, to prevent ruthenium dissolution. Even at the higher levels of iridium, e.g. 7%, the metallic electrodeposited layer must be subjected to an oxidizing treatment to oxidize the surface at least partially. Where more severe electrolysis conditions are used, a greater amount or iridium may be necessary to suppress ruthenium dissolution.

It was noted that even with the anodes where the iridium content was not sufficiently high for ruthenium dissolution to occur initially, in use anodically an oxide coating builds up which eventually protects the coating and prevents further dissolution of the ruthenium. However, to avoid the initial dissolution and to avoid the hazard of $RuO_4$ formation, a ruthenium dioxide-containing coating—formed by a non-electrolytic treatment—is provided on the surface of the electrode.

Before depositing a further layer on the electroplated ruthenium-iridium coating, however, the ruthenium-iridium alloy layer is treated in air to at least partially oxidize the surface. By this is meant the surface can be partially oxidized or essentially fully oxidized or the layer can be partially or essentially fully oxidized to any depth in the layer. Surface oxidation of the intermediate layer can be carried out at a temperature about 400° C. to about 900° C. in an atmosphere which is oxidizing to the deposit. Air is preferred.

In a preferred embodiment, heat treatment of the intermediate layer is carried out at about 400° C. to about 700° C., e.g., about 593° C. for about 5 to about 60 minutes, e.g., about 15 minutes. Advantageously the ruthenium-iridium layer has a thickness of about 0.1 μm to about 4 or 5 μm, preferably 0.5 μm to about 2 μm, e.g., about 1 μm. The surface oxidation need only be carried out to provide an observable color change of metallic to violet. This is an evidence of surface oxidation. It is known that various oxides will develop at least at the surface of ruthenium and iridium when subjected to such oxidation treatment. The ruthenium-iridium electrodeposited layer, which is believed to be an alloy, clearly oxidizes at least at the surface. A predominant phase present is $RuO_2$, which may be in solid solution with other oxides which develop at the surface.

In view of the dependence on the conditions of use, the electrode can be designed with the appropriate amount of iridium. For reasons of cost, consistent with electrode life, it is preferable to keep the iridium level as low as possible.

The surface layer in a preferred anode of this invention contains as an essential component ruthenium dioxide which has been developed from a non-electrolytically deposited source. This, as noted above, is to ensure that even initially there is no less of ruthenium anodically in use. Ruthenium dioxide is known to have a low oxygen over-potential, and its presence at the surface as an additional layer will also optimize the effectiveness of the material as an oxygen electrode. This in turn will enable the use of the electrode at a sufficiently low potential to minimize the possibility of initial dissolution of ruthenium. Other non-electrolytically active components may be present, e.g. for adherence, e.g., an oxide of substrate components such as $TiO_2$, $Ta_2O_5$ and the like. In a preferred embodiment of the invention the outer surface layer contains at least about 80% $RuO_2$. In the embodiment in which a non-active component is present the outer surface layer contains about 80% to about 99% ruthenium dioxide and about 1% to about 20% of the non-active component, e.g., titanium dioxide. Suitable outer layers may contain for example, 80% $RuO_2$-20% $TiO_2$, 85% $RuO_2$-15% $TiO_2$, 90% $RuO_2$-10% $TiO_2$, 80% $RuO_2$-10% $TiO_2$-10% $Ta_2O_5$. It is believed, however, that the requirement for a non-active component such as a valve metal oxide is less critical and may even be eliminated in the present electrodes. The reason for this is that the thickness requirements of the outer (non-electrolytic) $RuO_2$ deposit is not as critical in the present electrodes as in conventional electrodes made entirely of a paint-type deposit. Conventional paint-type electrodes require a thickness build-up in sequential deposits that have been reported to be as high as 8 coatings and higher with firing steps intermittently in the build-up. Since the $RuO_2$ (non-electrolytically deposited) layer can be thinner in the present electrodes, with no more than, for example, 1 or 2 coatings, the requirement for additional binders is lowered. Indeed durable anodes have been made using as the outer surface layer and a Ru-Ir layer, a $RuO_2$ developed from paints without any additional oxide component. Where resinates, or the like are used, some oxides may be derived from the usual commercial formulations, but such paint formulations can be applied without any additional oxides added.

Any non-electrolytic technique can be used for producing the ruthenium dioxide containing outer surface layer. Many methods are known, for example, for developing ruthenium dioxide coatings from aqueous or organic vehicles containing ruthenium values. For example, the ruthenium may be present as a compound such as a halide or resinate, which oxidizes to ruthenium dioxide when subjected to a heat treatment in an oxidizing atmosphere. Several methods for developing ruthenium dioxide surface coatings from non-electroplated coatings are described in the patents cited previously. In one method a ruthenium chloride in solution is applied as a paint and the coating of ruthenium dioxide is formed by dechlorination and oxidation of the ruthenium chloride. For example, a solution of $RuCl_3.3H_2O$ in a suitable carrier may be applied on a previously coated and treated composite by brushing, spraying or dipping. A sufficient number of coats are applied to provide a ruthenium content of at least about 0.1 $mg/cm^2$ of electrode surface area. The coatings may be fired individually or each may be allowed to dry and the final coating fired. Firing is carried out, e.g., in air at a temperature of about 315° C. to about 455° C., e.g., about 315° C. to about 455° C. for about 15 to about 60 minutes. Titanium or other nonactive components may be co-deposited with the ruthenium using conventional techniques. Typically the initial loading (i.e. prior to build-up in use) of the $RuO_2$-containing outer layer is at least about 0.1 $mg/cm^2$. Preferably, the initial loading is about 0.3 to about 1 $mg/cm^2$ in thickness. Since there is usually a build-up of $RuO_2$ during use in the cell, the initial thickness of $RuO_2$ is to ensure that precious metals of the intermediate layer do not dissolve before the proper build-up of $RuO_2$ can occur and to ensure a low oxygen overpotential in the cell. In this way precious metal loss is minimized.

As indicated above, in a preferred embodiment of the invention the composite electrode is used as an insoluble anode for the electrowinning of nickel. While not confined to any one process, nickel electrowinning processes are known which use electrolytes containing about 40 to 100 g/l nickel, 50 to 100 g/l sodium sulfate and up to 40 g/l boric acid in sulfuric acid to maintain a pH in the range of about 0 to 5.5. In one electrowinning process the anode is bagged, and the anolyte is a sulfate solution containing about 40 to 70 g/l nickel (as nickel sulfate), 40 g/l sulfuric acid, 100 g/l sodium sulfate, 40 g/l boric acid, and the anolyte at a pH of about 0. Electrowinning is carried out advantageously at a temperature of about 50° to 70° C. and at an anode current density of about 30–50 milliamps per square centimeter (mA/cm$^2$).

The following examples are intended to give those skilled in the art a better appreciate of the invention. In all the tests, anode potentials are measured in volts vs. a saturated calomel electrode (SCE) and H/T is an abbreviation to denote the conditioning of the layer of a composite sample, viz. the temperature, time and atmosphere. Loadings, e.g. of precious metals or their oxides, alloys, etc., in various layers are given as nominal values.

EXAMPLE I

This example illustrates the preparation of typical electrodes of the present invention, in which the barrier layer is palladium, and the activity of such electrodes when used as anodes for the electrowinning of nickel.

Several multilayer samples are prepared on a titanium substrate material as follows.

Surface roughened titanium sheet is cleaned and plated with a thin coating of a precious metal as a barrier layer. To roughen and clean the titanium it is sandblasted with $SiO_2$-sand, brushed with pumice, rinsed, cathodically cleaned in 0.5 M $Na_2CO_3$ to remove dirt and the remaining pumice particles then rinsed and dried. Thereafter, the cleaned substrate is plated with a thin deposit of palladium, the amount varying from about 0.1 to about 0.6 μm, using known electroplating baths. In some of the samples the palladium deposit is subjected to special treatment. For example, the palladium coated-titanium in some samples are subjected to a temperature of 593° C. for 1 hour in an atmosphere of 5% $H_2$-Bal $N_2$. It was found during the course of investigating the materials that such treatment of the palladium layer could be eliminated without noticeable harmful effects in the electrode life or performance.

A ruthenium-iridium intermediate, e.g., of about ½ to about 4 μm thickness, is plated on the palladium layer from a sulfamate bath to give a deposit containing about 4% iridium and the balance ruthenium. The bath, which is disclosed in the co-pending application referred to above, is maintained at a pH of 0.9 and a temperature of 57° C. and operated at a current density of 20 mA/cm$^2$. The ruthenium-iridium deposit is treated in air at a temperature of about 500° to 600° C. for about 10 to 20 minutes to oxidize the surface.

The surface $RuO_2$ layer is applied to each sample by painting the composite with 2 coats of a solution of $RuCl_3.3H_2O$ in n-butanol. After each application the electrode is dried under a heat lamp (about 65°–93° C.) to obtain a ruthenium chloride loading of about 1 mg/cm$^2$, and then the composite is heat treated in air for 60 minutes at about 450° C. to about 600° C. in order to convert the chloride to the dioxide of ruthenium.

A uniform, blue-black coating results which is adherent when finger rubbed, but not completely adherent when subjected to a tape test. The tape test involves firmly applying a strip of tape to the coating and rapidly stripping the tape off. The tape is then examined to see whether any of the coating has been pulled off from the substrate.

The samples are tested as anodes under conditions which simulate the anolyte in a bagged-anode nickel electrowinning, viz. an aqueous electrolyte composed of 70 g/l nickel (as nickel sulfate), 40 g/l sulfuric acid, 100 g/l sodium sulfate, and 10 g/l boric acid. The bath is maintained at a temperature of 70° C., a pH of 0 to 0.5, and an anode current density of 30 mA/cm$^2$. The tests are arbitrarily terminated when the anode potential reaches 2 volts (vs. SCE).

Life of typical samples are given in TABLE I, with variations in preparation of the sample noted.

The data in Table I show that anodes of the present invention are effective for electrowinning nickel, and further that current densities of 30 mA/cm$^2$ the anodes operate at very stable potentials in the neighborhood of about 1.19 to 1.4 volts/SCE.

EXAMPLE II

This example illustrates the effect of various treatment conditions on the outer coating and on the intermediate layer of the composite anode of this invention.

A. Effect on Outer Layer

Composite samples without barrier layers are prepared in a similar manner to that shown in EXAMPLE I, except that the final heat treatment in air of the $RuCl_3.3H_2O$ deposit is varied with respect to time and temperature. The samples are allowed to stand in 1N $H_2SO_4$, at temperatures up to 70° C. TABLE II-A shows the effect of variation in heat treatment of the $RuO_2$ layer on the anode.

TABLE I

| Sample I.D. | Barrier Layer Conditioning | Intermediate Layer Conditioning | Surface Layer Conditioning | Anode Potential and Life to 2 Volts vs. SCE |
|---|---|---|---|---|
| 1 | 0.1μm Pd<br>* | 0.5μm Ru-Ir<br>593° C.-15 m-air | 0.7 mg/cm$^2$ $RuO_2$<br>455° C.-60 m-air | 1.19–1.37V up to 4000 Hours<br>2V at 4200 Hours |
| 2 | 0.1μm Pd<br>— | 1μm Ru-Ir<br>593° C.-15 m-air | 0.5 mg/cm$^2$ $RuO_2$<br>453° C.-30 m-air | 1.16–1.36V up to 9330 Hours<br>** |
| 3 | 0.1μm Pd<br>— | 2μm Ru-Ir<br>593° C.-15 m-air | 0.5 mg/cm$^2$ $RuO_2$<br>453° C.-30 m-air | 1.16–1.38V up to 9640 Hours<br>** |
| 4 | 0.5μm Pd<br>* | 0.6μm Ru-Ir<br>593° C.-15 m-air | 0.5 mg/cm$^2$ $RuO_2$<br>453° C.-30 m-air | 1.19–1.38V up to 3850 Hours<br>2V at 4180 Hours |
| 5 | 0.5μm Pd<br>— | 1.3μm Ru-Ir<br>593° C.-15 m-air | 0.6 mg/cm$^2$ $RuO_2$<br>453° C.-30 m-air | 1.22–1.38V up to 6520 Hours<br>2V at 6860 Hours |

- - no conditioning treatment.
* - heat treated at 593° C. for 1 hour in 5% $H_2/N_2$.
** - still in test.
SCE - Saturated Calomel Electrode.

TABLE II-A

| Treatment | | |
|---|---|---|
| Temperature, °C. | Time, min | Effect |
| 260 | 15–60 | Dissolution |
| 315 | 30 | Stable |

TABLE II-A-continued

| Treatment | | |
|---|---|---|
| Temperature, °C. | Time, min | Effect |
| 370 | 30 | Stable |
| 425 | 15–60 | Stable |
| 455 | 30 | Stable |

The results show that at a temperature-time cycle which does not convert the ruthenium chloride deposit to the oxide, the coating will dissolve immediately on contact with the acid. Coating adherence improves with higher heat treatment temperatures, at 455° C., the adherence being demonstrably better than at 315° or 370° C. The optimum time of heat treatment, as determined by tape tests, is about 30–60 minutes.

B. Effect of Temperature-Time on Intermediate Layer

Samples are prepared by plating a Ru-4% alloy deposit on to a sandblasted, pumiced and cathodically cleaned titanium substrate. The ruthenium-iridium layer is subjected to various temperature-time cycles in air. Thereafter the composites are tested as anodes in 1N $H_2SO_4$ as electrolyte, ambient temperature and at an anode current density of 5000 A/m$^2$. TABLE II-B shows the effects of heat treatment conditions on the anode.

TABLE II-B

| Heat Treatment Conditions | Time in Hours to Cell Potential of 10 Volts |
|---|---|
| 426° C.-1 hr-air | 3 |
| 593° C.-15 min-air | 150 |
| 593° C.-30 min-air | 144 |
| 704° C.-1 hr-air | 36 |

The results in TABLE II show the preferred temperature-time cycle for heating the alloy is that equivalent to 593° C. for 15 to 30 minutes. At 704° C. for 1 hour the integrity of the co-deposit is damaged and the substrate is unduly oxidized. At 426° C. for 1 hour insufficient oxide is formed.

TABLE II-C

| Heat Treatment | Time in Hours to Anode Potential of 2 Volts |
|---|---|
| 593° C.-15 min-$O_2$ | 3200 |
| 593° C-15 min-air | 4200 |

EXAMPLE III

This example illustrates the effect of the addition of titanium to the ruthenium oxide outer layer.

A composite is prepared in a similar manner to that shown in EXAMPLE I, except that titanium chloride in the amount of 15 weight %, based on the weight of titanium, is added to the $RuCl_3.3H_2O$ solution, and the ruthenium coating solution is made with methanol rather than butanol.

The ruthenium chloride solution used to deposit the outer layer is prepared by dissolving $RuCl_3.3H_2O$ and an aqueous solution of $TiCl_3$ (20%) in methanol such that the ruthenium to titanium weight ratio is 85:15. The titanium is oxidized to the titanic (+4) state by the addition of $H_2O_2$. The resultant ruthenium- and titanium-containing solution is applied to the oxidized ruthenium-iridium alloy layer by applying several coats until the loading averages 1.2 mg/cm$^2$. Each coat is allowed to dry under a heat lamp (65°–93° C.) before the succeeding one is applied. After applying the final coat the electrode is heated in air for 30 minutes at 454° C. The resultant material has a blue-black outer layer that has good adherence, showing only slight coating lift-off in a tape test. Data for the tests are shown in TABLE III.

When tested in a simulated nickel electrowinning recovery cell, anodes of this type show an initial anodic potential substantially equivalent to that shown by coatings having a surface layer developed from a $RuCl_3.3H_2O$ paint containing no $TiCl_3$. The life in TABLE III is shorter than the life for comparable electrodes without $TiO_2$ in TABLE I. Possibly the coating technique must be improved.

TABLE III

| Samples I.D. | Barrier Layer Conditioning | Intermediate Layer Conditioning | Surface Layer Conditioning | Performance |
|---|---|---|---|---|
| III-1 | 0.2μm Pd | 0.5μm Ru-Ir | 0.7 mg/cm$^2$ $RuO_2/TiO_2$ | 1.25–1.38V to 3350 Hours |
| | 593° C.-1 Hr-5%$H_2$—$N_2$ | 593° C.-15 m-air | 453° C.-30 m-air | 2V at 3500 Hours |
| III-2 | 0.1μm Pd | 1.0μm Ru-Ir | 0.8 mg/cm$^2$ $RuO_2/TiO_2$ | 1.28–1.32V to 5600 Hours |
| | 593° C.-1 Hr-5%$H_2$—$N_2$ | 593° C.-15 m-air | 453° C.-30 m-air | 1.37–1.68V to 8000 Hours |
| | | | | 2V at 8500 Hours |

C. Effect of Atmosphere on Alloy Layer

Samples are prepared in a similar manner to those prepared in part B of this example except that the atmosphere of the heat treatment of the ruthenium-4 weight % iridium alloy layer is varied. The composites are used as anodes in a simulated nickel electrowinning bath, substantially as described in EXAMPLE I, except that the bath is maintained at 55° C. TABLE II-C gives a comparison of an electrode prepared by heat treating the alloy layer in an atmosphere of essentially pure $O_2$ with one treated in air.

EXAMPLE IV

This example illustrates the effect of a palladium barrier layer and an ruthenium-iridium intermediate layer, in accordance with the present invention, as oxygen electrodes in various tests.

Composite samples are prepared on roughened and cleaned titanium with layers deposited essentially as described in EXAMPLE I, except that samples were prepared with and without a palladium layer and with and without a ruthenium-iridium layer. One sample was prepared with an electrodeposited ruthenium intermediate layer. Variations in composition, treatment of the layers and the manner of testing are noted.

Part A

In the tests recorded in TABLE IV-A, Samples 7 and 8 have a thin electroplated deposit of palladium of 0.1 μm thickness, heat treated at 593° C. for 1 hour in 5% $H_2/N_2$. Samples 6, 7 and 8 have a surface coating of $RuO_2$ formed from a ruthenium trichloride-containing paint deposit heat treated at 454° C. for 30 min. in air. The $RuO_2$ loading is 0.5 mg/cm$^3$. Sample 8 has an intermediate layer between the palladium layer and $RuO_2$ layer of electrodeposited ruthenium-4% iridium. The ruthenium-iridium layer, which is 0.5μm in thickness is heated at 593° C. for 15 minutes in air before the outer $RuO_2$ layer is applied. Samples 6, 7 and 8 are used as anodes in a simulated nickel electrowinning anolyte, as described in EXAMPLE I. Data showing the time vs. anode potential for oxygen evolution are shown in TABLE IV-A.

TABLE IV-A

| Time, hrs | Anode Potentials in Simulated Ni Electrowinning Cell Operated at 300 A/m$^2$ and 70° C. Sample 6 Ti/$RuO_2$ | Sample 7 Ti/Pd/$RuO_2$ | Sample 8 Ti/Pd/Ru-Ir/$RuO_2$ |
|---|---|---|---|
| 1 | 1.28 | 1.20 | 1.20 |
| 100 | 1.27 | 1.23 | 1.27 |
| 336 | 2.7 | 1.25 | 1.26 |
| 500 | — | 1.26 | 1.25 |
| 672 | — | 1.28 | 1.25 |
| 1000 | — | 1.30 | 1.26 |
| 1164 | — | +2.0V | 1.27 |
| 2000 | — | — | 1.27 |
| 3000 | — | — | 1.29 |
| 4000 | — | — | 1.37 |
| 4200 | — | — | >2.0V |

The data in TABLE IV-A show: The electrode composed essentially of $RuO_2$ on Ti (Sample 6) operates at a good potential, but it has a short life as an oxygen electrode. The electrodes having a Pd-barrier layer (Samples 7 and 8) have operating potentials comparable to the $RuO_2$ working potential of Sample 6. The Ru-Ir intermediate layer increases the life of the oxygen electrode (Sample 8 vs. Sample 7), the potentials for Sample 8 being stabilized and low for about 4000 hours, which is roughly 4 times the life of Sample 7 without the Ru-Ir layer. It will be appreciated that, within certain limits, an increase in $RuO_2$ loading in the surface coating (i.e., the working layer) will increase the life of the electrode. The limits in thickness of the coating will be dictated largely by the technique for applying suitable $RuO_2$ coatings of the desired thickness and by considerations of cost.

Part B

In the tests recorded in TABLE IV-B, Sample 9 is prepared in accordance with the present invention with a Pd-barrier layer, an electrodeposited Ru-4%Ir intermediates layer and an $RuO_2$ surface layer. In Sample 10, the intermediate layer is electroplated Ru. Samples 9 and 10 are tests in a simulated nickel electrowinning anolyte essentially the same as described in EXAMPLE I, but operated at 55° C.

TABLE IV-B

| Sample | Anode Layers on Ti | Time in Hours to Anode Potential of 2 Volts |
|---|---|---|
| 9 | 0.1μm Pd(1)<br>0.5μm Ru-Ir(2) | >8407 |

TABLE IV-B-continued

| Sample | Anode Layers on Ti | Time in Hours to Anode Potential of 2 Volts |
|---|---|---|
| | 0.5 mg/cm$^2$ $RuO_2$(3) | (Still in Test) |
| 10 | 0.1μm Pd(1)<br>0.5μm Ru(2)<br>0.5 mg/cm$^2$ $RuO_2$(3) | 264 |

(1) Electroplated Deposit H/T = 593° C.-1 hr-5% $H_2/N_2$
(2) Electroplated Deposit H/T = 593° C.-15 min-air
(3) Paint Deposit H/T = 454° C.-30 min-air The data in Table IV-B show that the addition of iridium in the intermediate layer increases the life of the anode markedly.

Part C

In tests recorded in TABLE IV-C, Sample 11 which does not have a barrier layer is compared with Sample 12, in accordance with the present invention, as an oxygen electrode under severe conditions, viz. in 1N $H_2SO_4$ electrolyte at 5000 A/m$^2$.

TABLE IV-C

| Sample | Anode Layers on Ti | Time in Hours to Cell Potential of 10 Volts |
|---|---|---|
| 11 | 0.5μm Ru-Ir(2)<br>1.1 mg/cm$^2$ $RuO_2$(3) | 110 |
| 12 | 0.2μm Pd(1)<br>0.5μm Ru-Ir(2)<br>1.1 mg/cm$^2$ $RuO_2$(3) | 250 |

(1)Electroplated deposit (no H/T)
(2)Electroplated deposit H/T = 593° C.-15 min-air
(3)Paint deposit H/T = 454° C.-30 min-air The data in TABLE IV-C shows that the palladium barrier layer increases the durability of the anode.

EXAMPLE V

This example illustrates variations in the barrier layer. Composite samples are prepared with a variety of metals electroplated on roughened and cleaned titanium sheet, followed by an electroplated layer of Ru-4%Ir. Data showing the results of tests using such composites as anodes in a simulated nickel electrowinning electrolyte, essentially as described in EXAMPLE I, are given in TABLE V. The thickness of the various deposits and treatments to which the deposits are subjected (if any) are noted.

TABLE V

| Sample | Anode Layers on Ti | Time in Hours to Anode Potential of 2 Volts |
|---|---|---|
| V-1 | 0.1μm Pd(1)<br>1.0μm Ru-Ir(2) | >8000<br>(Still in Test) |
| V-2 | 0.1μm Pt(3)<br>1.1μm Ru-Ir(2) | 2230 |
| V-3 | 0.1μm Pt(4)<br>1.0μm Ru-Ir(2) | 4510 |
| V-4 | 0.07 mg/cm$^2$ Ir (x)<br>1.0μm Ru-Ir(2) | >7410<br>(Still in Test) |
| V-5 | None<br>1.0μm Ru-Ir(2) | 2136 |
| V-6 | Flash Coating Au(x)<br>1.1μm Ru-Ir(2) | (>213)* |
| V-7 | None<br>1.0μm Ru-Ir(2) | (114)* |

Conditioning treatments:
(1) 593° C.-1 hr-5% $H_2/N_2$
(2) 593° C.-15 min-air
(3) 593° C.-1 hr-N2
(4) 593° C.-1 hr-5% $H_2/N_2$ + 72 hours room temperature
(x) No Treatment
(*) Under accelerated test in 1 N $H_2SO_4$ at current density of 500 mA/cm$^2$ and ambient temperature to 10 volts cell voltage The data shows that Ir and Pd are particularly suitable as barrier layers and that an oxidation treatment improved the effectiveness of the platinum barrier layer. It is noted that the Pd layer in Sample V-1 was treated in a reducing atmosphere; as noted previously this treatment is not necessary for an effective Pd barrier layer. However, platinum requires the treatment in an oxidizing medium to be effective. Such platinum treatment is preferably carried out at room temperature.

EXAMPLE VI

This example shows the effect of variations in thickness of the Ru-Ir and Pd layers.

Part A—Variations in Thickness of Ru-Ir

Composite tri-layer samples, viz. Pd/Ru-Ir/$RuO_2$ on Ti, in accordance with the present invention, are prepared essentially the same as described in EXAMPLE I, with variations in thickness in the Ru-Ir layer. In the samples prepared the Pd and $RuO_2$ are constant, viz.

Pd=0.1 μm, H/T=593° C.—1 hr—5% $H_2N_2$ or no treatment $RuO_2$=0.5 mg/cm$^2$, H/T 454° C.—30 min in air.

The data in TABLE VI records the hours to 2V when tested in the simulated nickel electrowinning anolyte using the conditions noted in EXAMPLE I.

TABLE VI

| Sample | Intermediate Layer | Time in Hours to Anode Potential of 2 Volts |
|---|---|---|
| 13 | Ru-4% Ir = 0.5μm H/T-593° C.-15 min-air | 4200 |
| 14 | Ru-4% Ir = 1μm, H/T-593° C.-15 min-air | >9330 (Still in Test) |
| 15 | Ru-4% Ir = 2μm, H/T-593° C.-15 min-air | >9640 (Still in Test) |
| 16 | Ru-4% Ir = 4μm, H/T-593° C.-15 min-air | 2500 |

The data in TABLE VI show that electrodes of the present invention operate effectively with the variation in thickness of the Ru-4%Ir coating of from 0.5–4 μm, and the optimum thickness is in the range of about 1–3 μm.

Part B—Variation in Thickness of Pd

Samples are prepared of electroplated palladium on roughened and cleaned titanium sheet, with the thickness of the Pd-deposit varying from about 0.05 to about 1 μm, i.e., up to about 1.3 mg/cm$^2$ Pd. The samples are tested as oxygen electrodes in 1N $H_2SO_4$ at room temperature. A graph of potentials of the electrodes when operating at a constant current density of 2 mA/cm$^2$ as a function of Pd-loading shows that at a Pd level greater than 0.2 mg/cm$^2$, the surface behaves like pure Pd, an indication that the titanium surface is completely covered with palladium. Below about 0.2 mg/cm$^2$ of palladium, the titanium substrate influences the potential, as evidenced by the rise in potential as the Pd loading decreases below about 0.2 mg/cm$^2$.

EXAMPLE VII

This example illustrates the effect of iridium, the effect of an oxidation treatment in the intermediate layer, and the contribution of the $RuO_2$ layers of the present invention in tests as oxygen electrodes.

Composite samples are prepared, all having an electroplated ruthenium-containing layer with an iridium content varied from 0 up to about 12%. The electroplated layer is deposited directly on roughened and cleaned titanium. Each sample has an electrodeposit of about 1 mg/cm$^2$ loading. Thereafter, with the exception of Samples 24 and 25, each sample is subjected to a treatment at 593° C. in air for 15 minutes. Samples 18, 20 and 24 each have a further outer layer of $RuO_2$ (0.8 mg/cm$^2$) developed from a ruthenium-chloride-containing paint, which is subjected to a heat treatment of 450° C. for 30 hours in air. Sample 25 is comparable to Sample 21, except that it does not have an oxidation treatment. The samples are used as anodes in a 1N $H_2SO_4$ electrolyte operated at incremental current densities until a color change in the electrolyte is observed. White Teflon (Teflon is a DuPont Trademark) tape inserted at the stopper for each test is removed and examined. Effluent gas from the test container is bubbled through a solution of 1:5 of $H_2SO_3$:$H_2O$. No noticeable change occurs in the $H_2SO_3$. Observations are reported in TABLE VII.

TABLE VII

| Sample | Anode Layers | % Ir | Deposit on Teflon Coated Stopper | Ru in Solution g/l (Approx.) | Observations on Electrolyte |
|---|---|---|---|---|---|
| 17 | Ru | 0 | Black+ | 0.18 | Yellowing at 30 mA/cm$^2$ |
| 18 | Ru + $RuO_2$ | 0 | Brown-Black Smudge | 0.043 | Yellowing at 125 mA/cm$^2$ |
| 19 | Ru/Ir | 3.9 | Black | 0.003 | Yellowing at 50 mA/cm$^2$ |
| 20 | Ru/Ir + $RuO_2$ | 3.9 | None | 0.003 | Yellowing at 250 mA/cm$^2$ |
| 21 | Ru/Ir | 6.8 | Trace | 0.003 | Possibly More Red than Yellow at 250 mA/cm$^2$ |
| 22 | Ru/Ir | 9.4 | Trace | 0.003 | Pinking at 250 mA/cm$^2$ |
| 23 | Ru/Ir | 11.3 | Trace | 0.003 | Pinking at 250 mA/cm$^2$ |
| 24 | Ru/Ir*-$RuO_2$ | 9.4 | Trace | 0.007 | Yellowing at 30 mA/cm$^2$ |
| 25 | Ru/Ir* | 6.8 | Black-Brown | 0.0064 | Yellowing at 30 mA/cm$^2$ |

*No oxidation treatment.
Ru = an electroplated layer of Ru.
Ru/Ir = an electroplated layer of Ru-4Ir.
$RuO_2$ = a layer developed from a $RuCl_3$-containing paint.
+x-ray fluorescence of a similarly formed deposit showed the presence of ruthenium.

The results in TABLE VII show:

(1) The presence of Ir suppresses the corrosion of Ru. As the iridium content increases from 0 to 3.9 to 9.4% the current density at which coloring of the electrolyte begins rises from 30 to 250 mA/cm$^2$, and the deposits of $RuO_2.2H_2O$ on the tape decrease from black amounts to trace amounts (Cf Samples 17, 19, 22).

(2) The presence of $RuO_2$ developed on the surface from a non-electroplated deposit suppresses the formation of a ruthenium-containing deposit believed to be $RuO_2.2H_2O$ (via $RuO_4$ formation) and the corrosion of Ru in all cases. With no Ir present, there is less of a deposit on the tape with a $RuO_2$ surface layer than without it (Cf Samples 17 and 18), and corrosion begins at a higher current density. In Ru-Ir deposits not heat treated, the ruthenium-containing deposits on the tape are less when $RuO_2$ is present, and the corrosion of Ru is also to a lesser amount (Cf Samples 25 and 24). When the Ru-Ir deposit is heat treated and $RuO_2$ is present, no ruthenium-containing deposit is found at current densities up to about 250 mA/cm$^2$ (Cf Sample 20).

(3) Further the results show oxidation of the Ru-Ir layer is necessary to form a protective oxide film. When Ru-Ir is not heat treated, corrosion of Ru began at 30 mA/cm$^2$ and a black-brown deposit is present on the tape. When Ru-Ir is heat treated, corrosion began at much higher current densities, and the volatiles were reduced to trace amounts (Cf Samples 21 and 25).

From the results it can be seen that the optimum amount of iridium in the Ru-Ir can be predetermined for given conditions of operation based upon, e.g., corrosion and economics. For example, the Sample 20 containing about 3.9% iridium and having an $RuO_2$ outer coating may be used at current densities up to 250 mA/cm$^2$ without noticeable dissolution of the ruthenium in the electrolyte. It appears from the data that less than 4% iridium may be used with the $RuO_2$ for lower current densities of the order of 30–50 mA/cm$^2$, e.g., 1% or 2% may be sufficient.

EXAMPLE VIII

This example illustrates the effect of the iridium level in a ruthenium-iridium layer.

In the experiments of this example composite samples composed of a ruthenium-iridium electroplated deposit on roughened and cleaned titanium are tested in an accelerated life test. The ruthenium-iridium deposits contain various amounts from zero up to about 25% iridium (by weight).

Results with typical samples prepared under comparable conditions are reported in TABLE VIII.

TABLE VIII

| Sample | % Ir | Time in Hours to Cell Potential of 10 Volts |
|---|---|---|
| 26 | 0 | 0.3 |
| 27 | 0.7 | 95 |
| 28 | 2 | 105 |
| 29 | 3 | 110 |
| 30 | 6.1 | 114 |
| 31 | 6.3 | 120 |
| 32 | 8.1 | 112 |
| 33 | 9.4 | 118 |
| 34 | 11 | 179 |
| 35 | 21.3 | 426 |

It will be appreciated that the selected results reported in TABLE VIII are for rough screening tests. Some tests not reported in the table showed poor performance at high levels of iridium and good lift at low levels of iridium. However, the life of the electrodes will vary markedly depending on such factors as the type of bath used, plating conditions, thickness of the coating, treatment conditions, integrity of the deposit, etc. It is believed, however, that the results tabulated in TABLE VIII are for relatively comparable samples and that in general the experiments showed a trend, as indicated.

As noted previously the present anodes are particularly useful for electrowinning nickel. The electrodes may also be used for recovering nickel-cobalt deposits from a suitable electrolyte under comparable conditions and with suitably low anode potentials, e.g. of the order of about 1.15–1.3V/SCE.

Although the present invention has been described in conjunction with preferred embodiments, it is to be understood that modifications and variations may be resorted to without departing from the spirit and scope of the invention are those skilled in the art will readily understand. Such modifications and variations are considered to be within the purview and scope of the invention and appended claims.

What is claimed is:

1. In a process for producing a composite electrode for use in an electrolytic cell comprising a valve metal substrate and an outer surface layer comprising ruthenium dioxide, the improvement which comprises providing: (a) a barrier layer comprising a platinum group metal directly on the substrate and (b) between the barrier layer and outer surface layer an intermediate layer comprising a metallic electroplated deposit consisting of ruthenium and iridium, said intermediate layer containing at least a small but effective amount of iridium to reduce ruthenium dissolution during use in said cell, and said intermediate layer being at least partially oxidized.

2. A process according to claim 1, wherein the metallic electroplated layer of ruthenium and iridium is subjected to a temperature of about 400° C. to about 900° C. for about 5 to about 60 minutes in an oxidizing atmosphere to at least partially oxidize the surface of said layer before depositing the outer surface layer.

3. A composite electrode for use as an insoluble anode in an electrolytic cell, and especially useful in a process for electrowinning a metal, which comprises an electroconductive substrate having on at least a portion of the surface thereof a multilayer coating, said coating consisting essentially of:

(a) a barrier layer directly on the substrate;

(b) a non-electroplated outer surface layer comprising ruthenium dioxide; and (c) an intermediate layer between the barrier layer and outer surface layer comprising an electroplated metallic deposit of ruthenium and iridium, said intermediate layer being at least partially oxidized.

4. In a process for electrowinning a metal from solution, the improvement which comprises using as the anode a composite electrode, according to claim 3.

5. The process according to claim 4, wherein the electrowinning process is carried out at an anode current density of up to about 50 mA/cm$^2$ and the ruthenium-iridium intermediate layer contains at least about 1% iridium.

6. A process according to claim 4, wherein the process is for the electrowinning of nickel.

7. A process according to claim 6, wherein the nickel contains cobalt.

8. A process according to claim 4, wherein the electrowinning process is carried out at an anode current density greater than about 50 mA/cm$^2$ and the ruthenium-iridium intermediate layer contains at least about 2% iridium.

9. A process according to claim 4, wherein the electrowinning process is carried out at an anode current density greater than about 50 mA/cm$^2$ and the ruthenium-iridium intermediate layer contains about 4% iridium.

10. A composite electrode of claim 3, wherein the intermediate layer contains at least a small but effective amount of iridium for reduction of ruthenium loss during operation of the electrolytic cell.

11. A composite electrode according to claim 3, wherein the barrier layer is selected from at least one of the group consisting of a platinum group metal, gold, and alloys, mixtures, intermetallics and oxides thereof and the group further consisting of silicides, nitrides and carbides of at least one of the components of the substrate.

12. A composite electrode for use in an electrolytic cell, and especially useful as an anode in a process for electrowinning nickel, which comprises a valve metal substrate having on at least a portion of the surface thereof a multilayer coating, said coating consisting essentially of:

(a) a barrier layer directly on the substrate, said barrier layer comprising a platinum group metal;

(b) a non-electroplated outer surface layer comprising ruthenium dioxide; and (c) an intermediate layer between the barrier layer and outer surface layer comprising an electroplated metallic deposit of ruthenium and iridium, said intermediate layer being at least partially oxidized directly at the surface adjacent to the ruthenium dioxide outer surface layer.

13. A composite electrode according to claim 12, wherein the platinum group metal is selected from the group consisting of palladium, iridium, rhodium and platinum.

14. A composite electrode, according to claim 13, wherein the platinum group metal is electroplated on the substrate.

15. A composite electrode according to claim 14, wherein the platinum group metal is a flash coating of iridium.

16. A composite electrode, according to claim 13, wherein the platinum group metal is palladium and said barrier layer is at least about 0.05 μm in thickness.

17. A composite electrode according to claim 13, wherein the platinum group metal is platinum and the barrier layer is treated in an oxidizing medium.

18. A composite electrode according to claim 12, wherein the outer surface layer consists essentially of at least 80% $RuO_2$.

19. A composite electrode according to claim 18, wherein the outer surface layer contains up to about 20% non-active component.

20. A composite electrode according to claim 18, wherein the outer surface layer is essentially free of an added non-active component.

21. A composite electrode according to claim 12, wherein the intermediate layer is subjected to a heat treatment to oxidize at least a portion of the outer surface of said layer.

22. A composite electrode according to claim 21, wherein the heat treatment is effected at a temperature of about 400° C. to about 900° C. in an oxidizing atmosphere.

23. A composite electrode according to claim 12, wherein the valve metal substrate comprises titanium.

24. A composite electrode according to claim 12, wherein the platinum group metal-containing barrier layer has a thickness of small but effective amount to preserve the current carrying capacity of the electrode under $O_2$ evolution up to about 0.5 μm.

25. A composite electrode according to claim 12, wherein the intermediate layer contains at least a small but effective amount of iridium to suppress ruthenium dissolution during operation of the electrolytic cell.

26. A composite electrode according to claim 12, wherein the intermediate layer has a thickness of at least about 0.1 μm.

27. A composite electrode according to claim 12, wherein the intermediate layer contains about 1% up to about 36% iridium.

28. A composite electrode according to claim 12, wherein the ruthenium dioxide layer is developed by decomposition and oxidation of a ruthenium compound deposited in a vehicle on the intermediate layer.

29. A composite electrode according to claim 12, wherein the ruthenium dioxide outer layer is developed at a temperature of 315° C. to 455° C. in an oxidizing atmosphere.

30. A composite electrode according to claim 12, wherein the ruthenium content of the ruthenium dioxide outer layer is at least about 0.1 mg/cm$^2$.

31. A composite electrode according to claim 12, wherein the valve metal substrate is a surface layer on a more conductive metal.

32. A composite electrode for use in an electrolytic cell, and especially useful as an anode in a process for electrowinning a metal, which comprises a valve metal substrate having on at least a portion of the surface thereof a multilayer coating, said coating consisting essentially of:

(a) a barrier layer directly on the substrate, said barrier layer comprising a platinum group metal of at least about 0.05μm in thickness;

(b) a non-electroplated outer surface layer comprising ruthenium dioxide and having a ruthenium content of at least about 0.1 mg/cm$^2$; and (c) an intermediate layer between the barrier layer and outer surface layer, said intermediate layer comprising an electroplated metallic deposit of ruthenium and iridium, the iridium component of said deposit being at least a small but effective amount to reduce ruthenium dissolution during operation of said electrolytic cell, said intermediate layer having a thickness of at least about 0.1 μm, and said intermediate layer being at least partially oxidized directly at the surface adjacent to the ruthenium dioxide outer surface layer.

* * * * *